US010957960B2

(12) United States Patent
Basavarajappa et al.

(10) Patent No.: US 10,957,960 B2
(45) Date of Patent: Mar. 23, 2021

(54) TUNABLE FILTER WITH MINIMUM VARIATIONS IN ABSOLUTE BANDWIDTH AND INSERTION LOSS USING A SINGLE TUNING ELEMENT

(71) Applicants: Gowrish Basavarajappa, Waterloo (CA); Raafat R Mansour, Waterloo (CA)

(72) Inventors: Gowrish Basavarajappa, Waterloo (CA); Raafat R Mansour, Waterloo (CA)

( * ) Notice: Subject to any disclaimer, the term of this patent is extended or adjusted under 35 U.S.C. 154(b) by 0 days.

(21) Appl. No.: 16/713,198

(22) Filed: Dec. 13, 2019

(65) Prior Publication Data

US 2020/0227804 A1 Jul. 16, 2020

Related U.S. Application Data

(60) Provisional application No. 62/779,873, filed on Dec. 14, 2018.

(51) Int. Cl.

| | |
|---|---|
| ***H01P 1/207*** | (2006.01) |
| ***H01P 1/205*** | (2006.01) |
| ***H01P 1/202*** | (2006.01) |
| ***H01P 1/208*** | (2006.01) |

(52) U.S. Cl.
CPC ..... *H01P 1/2056* (2013.01); *H01P 1/202* (2013.01); *H01P 1/207* (2013.01); *H01P 1/2084* (2013.01)

(58) Field of Classification Search
CPC ..... H01P 1/207; H01P 1/208; H01P 1/212; H01P 1/205; H01P 1/202; H01P 1/2084; H01P 1/20; H01P 1/2002; H01P 5/00; H01P 5/02; H01P 5/024; H01P 5/04; H03H 7/12
USPC ..... 333/209, 208, 202, 261
See application file for complete search history.

(56) References Cited

U.S. PATENT DOCUMENTS

| | | | | |
|---|---|---|---|---|
| 6,147,577 | A | 11/2000 | Cavey | |
| 6,255,920 | B1 * | 7/2001 | Ohwada | H01P 1/2039 333/206 |
| 7,352,263 | B2 | 4/2008 | Pance et al. | |
| 7,705,694 | B2 | 4/2010 | Craig et al. | |
| 9,620,836 | B2 | 4/2017 | Jolly et al. | |
| 2014/0028415 | A1 | 1/2014 | Perigaud et al. | |
| 2015/0180105 | A1 | 6/2015 | Jolly et al. | |
| 2016/0049710 | A1 | 2/2016 | Huang et al. | |
| 2019/0140334 | A1 * | 5/2019 | Tkadlec | H01P 1/208 |

FOREIGN PATENT DOCUMENTS

| | | | |
|---|---|---|---|
| EP | 2690702 | A1 | 1/2014 |

* cited by examiner

*Primary Examiner* — Stephen E. Jones
(74) *Attorney, Agent, or Firm* — Nasser Ashgriz; UIPatent Inc.

(57) ABSTRACT

The present invention is a high Q tunable co-axial filter, which maintains a constant absolute bandwidth and a constant Q over the tuning range. The present filter can be tuned by a single rotational mechanism irrespective of the filter order. A plurality of tunable resonators is aligned on a common filter axis. Each resonator has a casing having an inner wall and a cavity. The resonators are coupled by an iris opening. A pair of end plates completes the filter casing. A rotating rod placed on the common axis of the resonated, that has a tuning post attached to it, and each post located in each resonator, is used to tune the filter.

18 Claims, 16 Drawing Sheets

TUNABLE FILTER WITH MINIMUM VARIATIONS IN ABSOLUTE BANDWIDTH AND INSERTION LOSS USING A SINGLE TUNING ELEMENT

FIELD OF INVENTION

The present invention relates to the design and development of a tunable bandpass filter.

DESCRIPTION OF BACKGROUND ART

Tunable bandpass filter is one of the vital components of frequency reconfigurable (or frequency agile) wireless systems which facilitate effective utilization of allotted frequency spectrum. Furthermore, frequency reconfigurable wireless systems can be a cost effective solution for wireless base-stations as well as for satellite & aero-space applications. In satellite application, on orbit flexible payload (or programmable payload) is one such encouraging development on the horizon. These systems inevitably require high Q (Quality factor) tunable bandpass filters with a constant absolute bandwidth over the tuning range.

One of the important requirements for tunable filters in most applications is to maintain constant absolute bandwidth over the tuning range. The data rate is bandwidth dependent thus maintaining the same date rate over the tuning range requires maintaining the same bandwidth. In addition, most of communication system applications require maintaining certain isolation requirements outside the band, which cannot be satisfied if the bandwidth is changed. Thus by maintaining a constant bandwidth over the tuning range, the achievable data rate and the filter isolation requirements remain the same over the entire tuning range, which is highly desirable.

Co-axial filters (or Combline or Evanescent mode or inter-digital filters) which are mechanically tuned are capable of achieving high Q (and hence lower loss). Typically, such filters require a tuning mechanism for each resonator to achieve the desired constant absolute bandwidth over the tuning range. In other words, the number of tuning mechanisms utilized in such filters is equal to the filter order, thus making them bulky and expensive. Hence it is highly desirable to achieve filter tuning with a single tuning mechanism yet maintaining constant absolute bandwidth. Ideally, a tunable bandpass filter is desired to maintain constant absolute bandwidth over a reasonably large tuning range with low insertion loss, where the filter is tuned using a single mechanism. A single tuning mechanism not only reduces the complexity of the closed loop control system but also results in enhanced reliability for aero-space applications.

Over the years significant inventions have been developed to realize tunable bandpass filters which have low loss (i.e. high-Quality Factor—high Q), however as will be explored below in detail these inventions utilize multiple tuning elements.

With respect to tunable co-axial filters, US patent application 2016/0049710 disclosed a high Q (lower loss) and constant absolute bandwidth over the tuning range. The invention utilizes mechanism to change the gap between resonator post and tuning disk, thus changing the frequency response of the filter. EP 2 690 702 A1 discloses a frequency tuning by changing the orientation of elliptic tuning disk. This invention does maintain a constant absolute bandwidth however the tuning range is extremely narrow (less than 2%). Similarly, U.S. Pat. No. 7,705,694 B2, discloses a frequency tuning by rotating elliptical dielectric resonators. The invention has considerable bandwidth variation over the tuning range of the filter. U.S. Pat. No. 6,147,577A discloses a tunable ceramic (dielectric resonator) filter which utilizes mechanism to vary the gap at the resonator. Similarly, US 2014/0028415 discloses a tunable bandpass filter which maintains a constant absolute bandwidth over the tuning range. The tuning is achieved by rotating each resonator within the filter. U.S. Pat. No. 7,352,263B2 discloses a variety of method and mechanisms to tune the frequency of a resonator by changing gaps and rotating the resonators. However, all the above inventions require a tuning mechanism for each resonator. Thus, the number of tuning mechanisms required is equal to the filter order.

US 2015/0180105 and U.S. Pat. No. 9,620,836 B2 disclose a waveguide cavity filter with dielectric insert in each cavity. The cavity utilizes two orthogonal modes and has two tuning states which are achieved by rotating the tuning rod either in vertical position or in horizontal position. As a result, the filter cannot be continuously tuned between these two states. Moreover, the tuning range between the two states is also quite low (less than 6%). Furthermore, such a filter at lower frequency spectrum (example around 2.5 GHz) would be extremely bulky. In-addition the filter can tune between only two fixed frequencies and cannot be tuned for frequencies in-between.

The majority of the reported inventions use multiple tuning mechanisms (at-least equal to the filter order) and do not present means to realize tunable filters with a constant absolute bandwidth. In this invention a prototype of a high Q tunable filter is disclosed which maintains a constant absolute bandwidth and insertion loss over the tuning range. Furthermore, the filter can be tuned by a single tuning mechanism. The tuning range of the filter is over at least 30%. The tunability is achieved by rotating a single tuning rod over which all the resonator posts are placed. Furthermore, the invention can be extended to dielectric resonator filters utilizing TM modes.

SUMMARY OF THE INVENTION

The present invention is a filter that achieves a constant absolute bandwidth and insertion loss over the tuning range using only one tuning mechanism. This invention finds utility in wireless communication applications requiring frequency agile (or frequency reconfigurable) systems. The filter is especially suitable in RF, microwave and millimeter-wave wireless communication applications.

The present tunable filter comprises of a plurality of tunable resonators that are coaxially aligned on a common filter axis. Each of the tunable resonators comprises of a casing having an inner wall and a cavity. The shape of the cavity is predetermined for filter tuning. In one embodiment of the present invention, the cross sectional shape of the cavity is elliptical. However, other cross-sectional shapes can also be designed. The resonators are connected through inter-resonator coupling structure to operably couple the tunable resonators to provide a balanced electromagnetic coupling with a constant normalized value. The inter-resonator couplings are iris's that have special shapes. In one embodiment, an elliptical iris is used for the elliptical resonators. The resonators are tuned using a single rotating rod that is located along the axis of all resonators. In each resonator, there is a tuning post that is attached to the rotating rod. The shape of the post is designed for the desired tuning. The shape of the posts are selected to improve the spurious performance of the tunable filter. As the posts are rotated by the rotating rod, a gap between each post and the inner walls of each tunable resonator changes and hence the frequency of the resonator also changes. Therefore, rotating the post tunes the frequency of the resonator and hence the filter. And rotating the rotating rod, tunes all resonators in the filter. A pair of end plates each having a SMA connector are attached to the first and the last resonator, and probes are mounted on to the SMA connector on each end plate. The filter also has input/output ports to connect the tunable filter to an external device. A set of tuning screws mounted in the casing of each tunable resonator are provided for fine tuning. In addition, the end plates hold the rotating rod using a ball-bearing or any other suitable bearing, for easy rotation.

The present tunable filter is tuned by a single rotational mechanism irrespective of the filter order. By rotating the rotating tube, the filter center frequency is tuned, while maintaining a constant absolute bandwidth and insertion loss over the tuning range. As the resonator post is rotated, the suitably shaped probe provides the required IO coupling as per design criteria for achieving constant absolute BW over the tuning range.

The principal objective of the present invention is the provision of a novel configuration for a tunable filter that is capable of realizing constant absolute bandwidth and insertion loss over a wide tuning range using a single tuning mechanism.

One objective of the present invention is to provide a filter that can be tuned by a single tuning element with minimum variations in absolute bandwidth and insertion loss over the tuning range.

Another objective of the present invention is to reduce the production cost of communication systems.

Another objective of the present invention is to reduce the delivery schedule of the communication systems.

Another objective of the present invention is to have less number of filter that can be easily reconfigured during production phase to fit the required frequency plan.

Another object of the present invention is to allow building of the filters ahead of time to offer a competitive delivery schedule.

BRIEF DESCRIPTION OF THE DRAWINGS

Embodiments herein will hereinafter be described in conjunction with the appended drawings provided to illustrate and not to limit the scope of the claims, wherein like designations denote like elements, and in which:

DETAILED DESCRIPTION

In the present invention, the requirement of constant absolute bandwidth is taken into account right at the beginning of the design. In general, bandpass filters can be designed for constant absolute bandwidth using Coupling Matrix model. In this model, the entire filter design can be divided into two major steps. One is to design appropriate coupling between the resonators (i.e. inter-resonator coupling), and the other step is to design input/output coupling where the filter is connected to other external components/sub-system in an application. From the [ref 9—text book], inter-resonator coupling and input/output couplings can be expressed using equation 1 and equation 2, respectively.

$$k_{ij} \times f_r = M_{ij} \times BW \tag{1}$$

$$\tau_{s11_max} = 4/(2\pi\, BW \times M_{s1}^2) \tag{2}$$

where, $k_{ij}$ is the physical coupling co-efficient between the resonators, $f_r$ is the centre frequency, $M_{ij}$ is the normalized coupling co-efficient between the resonators, BW is the absolute bandwidth, $M_{s1}$ is the normalized coupling co-efficient at input (or output) and $\tau_{s11_max}$ is the peak input (or output) reflection group delay. The normalized coupling co-efficient ($M_{ij}$ and $M_{s1}$) depends only on the filter type and its order, and not on center frequency and bandwidth. As a result, from the model based on coupling co-efficient, the two key requirements to design a filter for constant absolute bandwidth are:

A constant peak input/output reflection group delay ($\tau_{s11_max}$) with respect to $f_r$ (center frequency) over the tuning range.

A constant $k_{ij}*f_r$ product over the tuning range.

Figure 1A:
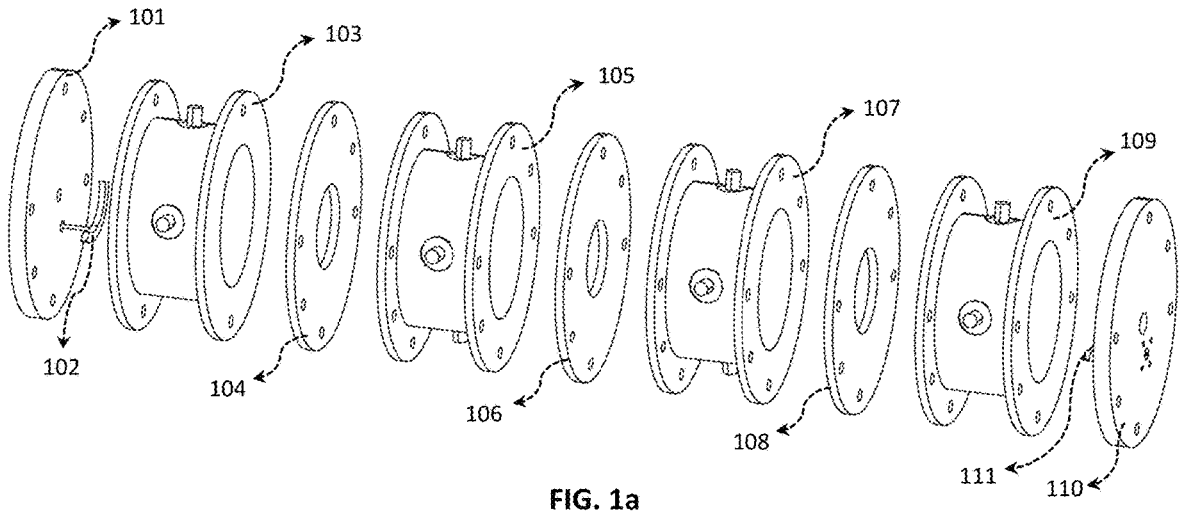
FIG. 1*a* shows the isometric view drawing of the first embodiment of the invention in exploded condition identifying different parts of the tunable filter.
Figure 1B:
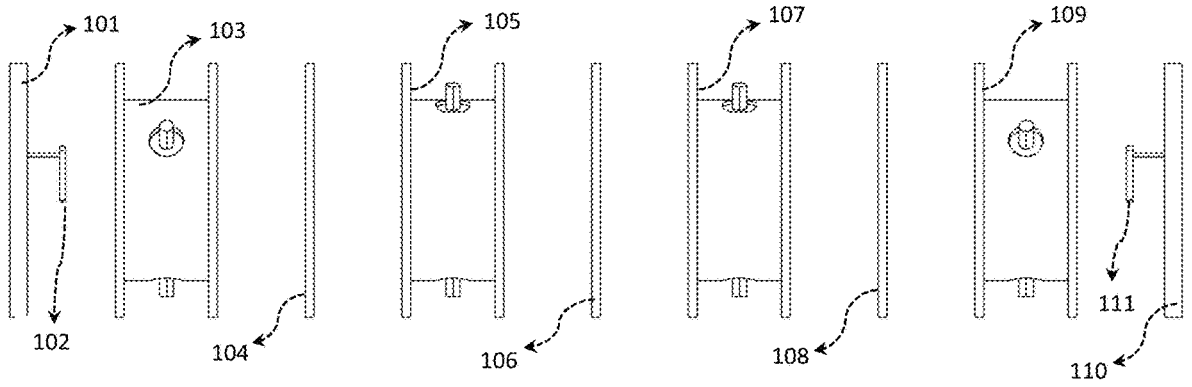
FIG. 1*b* shows the side view drawing of the first embodiment of the invention in exploded condition identifying different parts of the tunable filter.
Figure 2A:
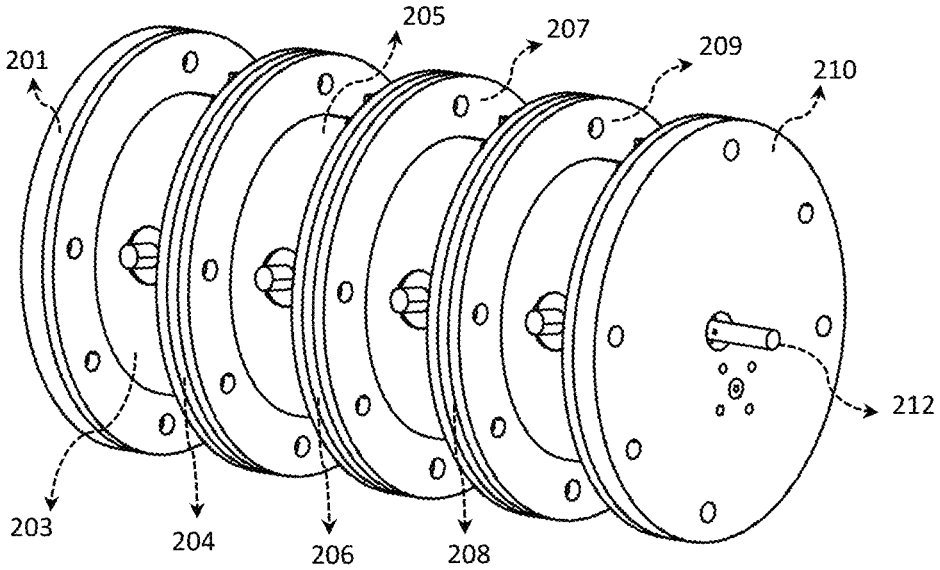
FIG. 2*a* shows the isometric view of the first embodiment of the invention when assembled.
Figure 2B:
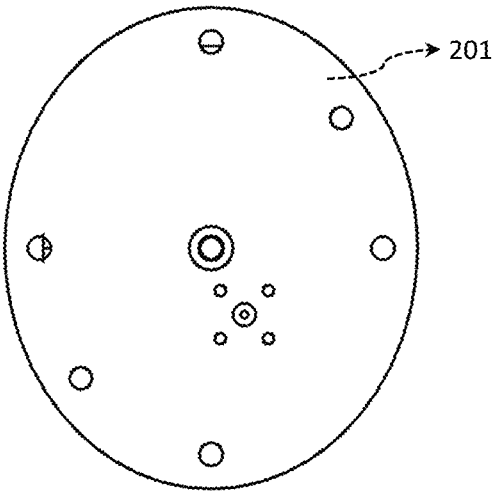
FIG. 2*b* shows the front view of the first embodiment of the invention when assembled.
Figure 2C:
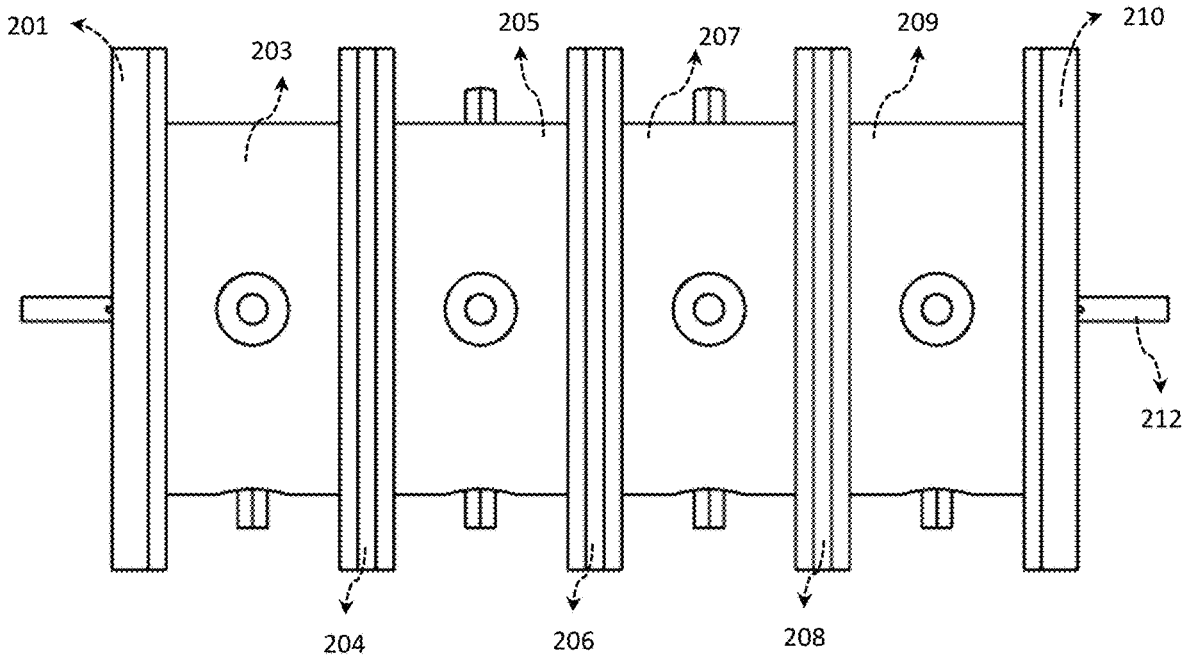
FIG. 2*c* shows the side view of the first embodiment of the invention when assembled.
Figure 2D:
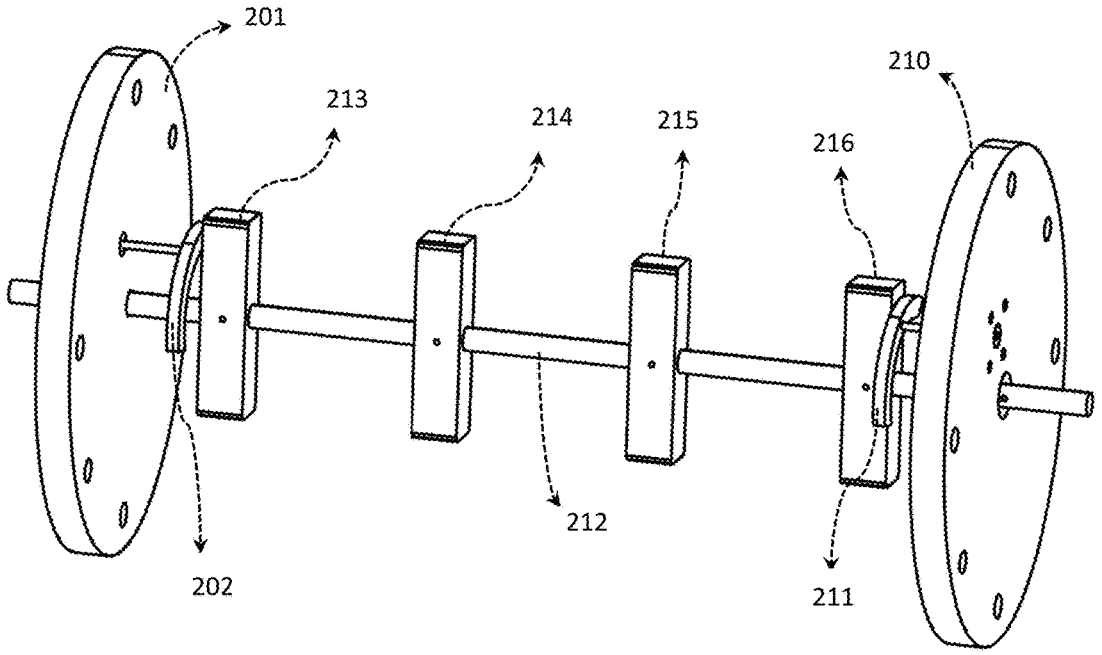
FIG. 2*d* shows the isometric view of the inside of the first embodiment of the invention when assembled.
Figure 3A:
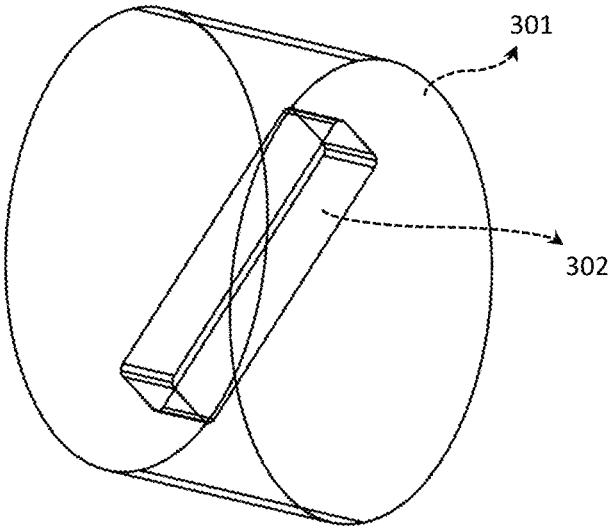
FIG. 3*a* depicts the isometric view of the post resonator with elliptical cavity.
Figure 3B:
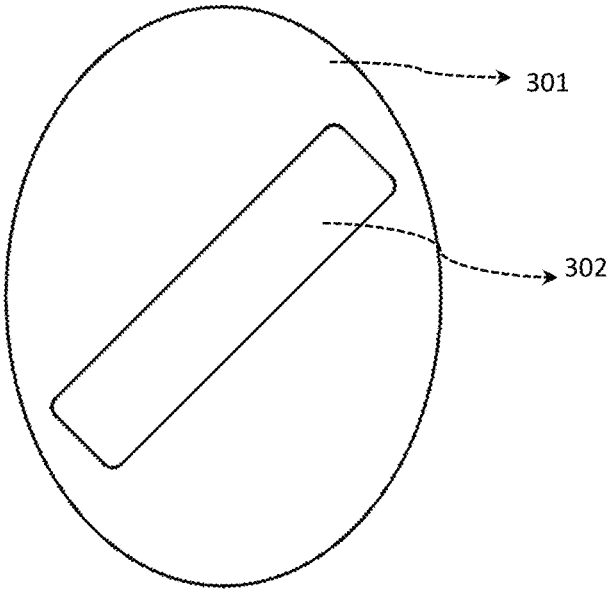
FIG. 3*b* depicts the front view of the post resonator with elliptical cavity.
Figure 3C:
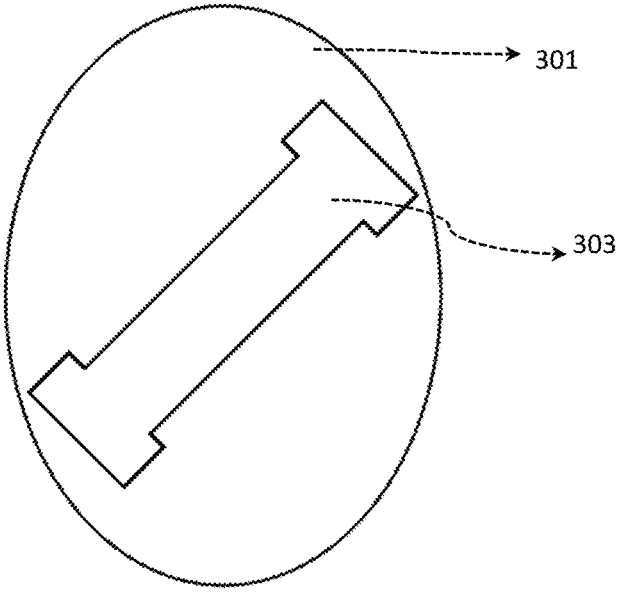
FIG. 3*c* shows the front view of a resonator with stepped impedance post resonator with elliptical cavity.
Figure 3D:
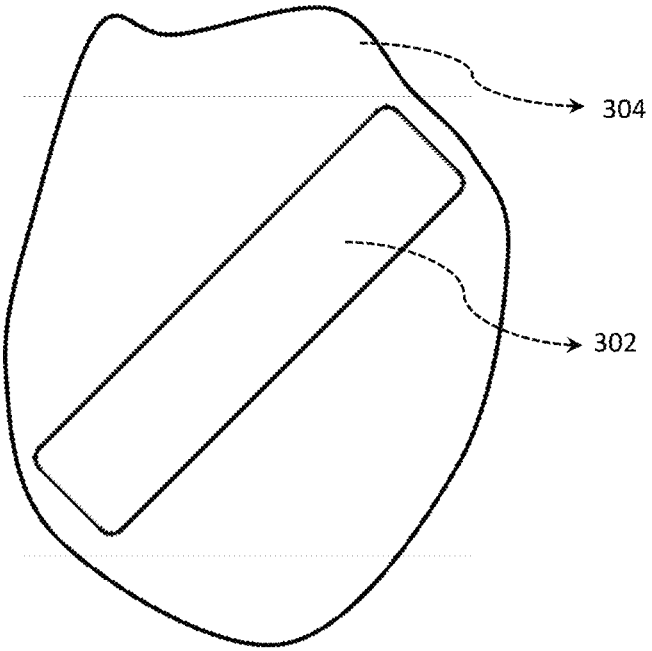
FIG. 3*d* shows the front view of a resonator with generic cavity.
Figure 3E:
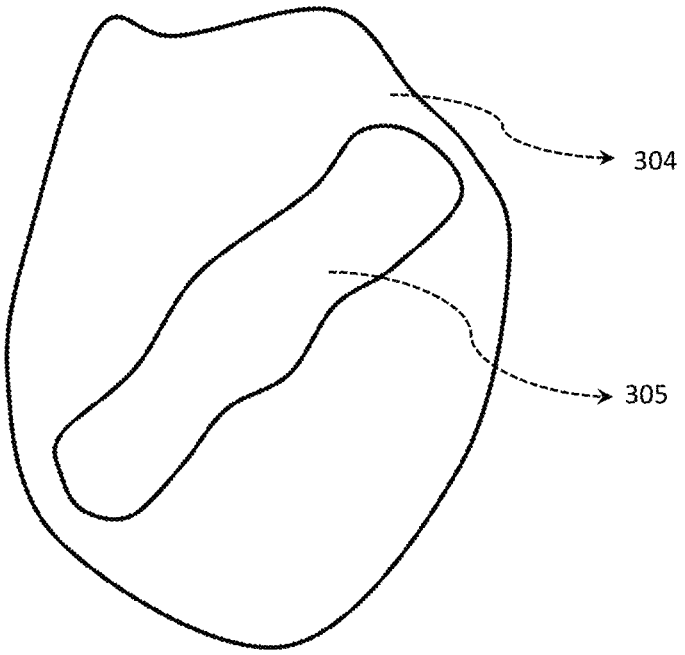
FIG. 3*e* shows the front view of a resonator with generic cavity and generic post is depicted.

The next step is to realize the physical inter-resonator coupling and input/output coupling to match the above requirements. FIG. 1 depicts the drawings of the first embodiment of the invention in exploded condition identifying different parts of the tunable co-axial filter. The isometric view is shown in FIG. 1*a*, whereas the side view is depicted in FIG. 1*b*. The inter-resonator couplings are realized using elliptic iris openings 104, 106 and 108. The input/output couplings are realized using circular-shaped probes 102 and 111 mounted on to SMA connectors. The elliptical casings (103, 105, 107 and 109) and end-plates (101 and 110) complete the filter housing. The fine tuning screws are mounted in the elliptical casings. The ball-bearing is placed on the end plates.

FIG. 2 depicts the drawings of the first embodiment of the invention in the assembled condition identifying different parts of the tunable co-axial filter. The isometric view is shown in FIG. 2*a*. 201 and 210 identify the end plates of the filter. The elliptical casings are identified as 203, 205, 207 and 209. The iris openings are marked as 204, 206 and 208. The PTFE (or plastic) tuning rod (or rotating rod) 212 is placed on the end plates (201 and 210) using ball-bearings. FIG. 2*b* depicts the front view of the filter. The side view is shown in FIG. 2*c*. The isometric view of the internal details of the filter is shown in FIG. 2*d*. The metallic posts 213, 214, 215 and 216 are placed on the rotating rod 212. The circular-shaped probes 202 and 211 are mounted on to SMA connector at end plates 201 and 210.

FIG. 3 depicts the drawings of the resonator post with elliptical cavity. The isometric view is shown in FIG. 3*a* and the front view in FIG. 3*b*. The resonator is basically a half-wavelength co-axial resonator with elliptical cavity. As the metallic post 302 (or dielectric post—TM mode) is rotated inside the elliptical cavity 301, the gap between the metallic post and elliptical cavity changes and hence the frequency of the resonator also changes. Thus rotating the metallic post tunes the frequency of the resonator and hence the filter. To improve the spurious performance of the filter, the post can be suitably shaped. One such widely used variations are depicted in FIG. 3*c*. The post shown in FIG. 3*c* has a hat on both the ends. This pushes the spurious frequencies further away. In-addition, the resonator dimensions get reduced due to extra capacitive loading. In general, the cavity 304 can be shaped other than elliptic as shown in FIG. 3*d*. Furthermore, even the metallic post 305 can also be shaped suitably other than rectangular (or cuboidal) as shown in FIG. 3*e*. Thus, a generic resonator can have custom shaped metallic post 305 within a custom shaped cavity 304 as shown in FIG. 3*e*. Furthermore, the invention can be extended to dielectric resonator filters. Thus the resonator post can be made from dielectric (or ceramic) material and so is the cavity.

Figure 4A:
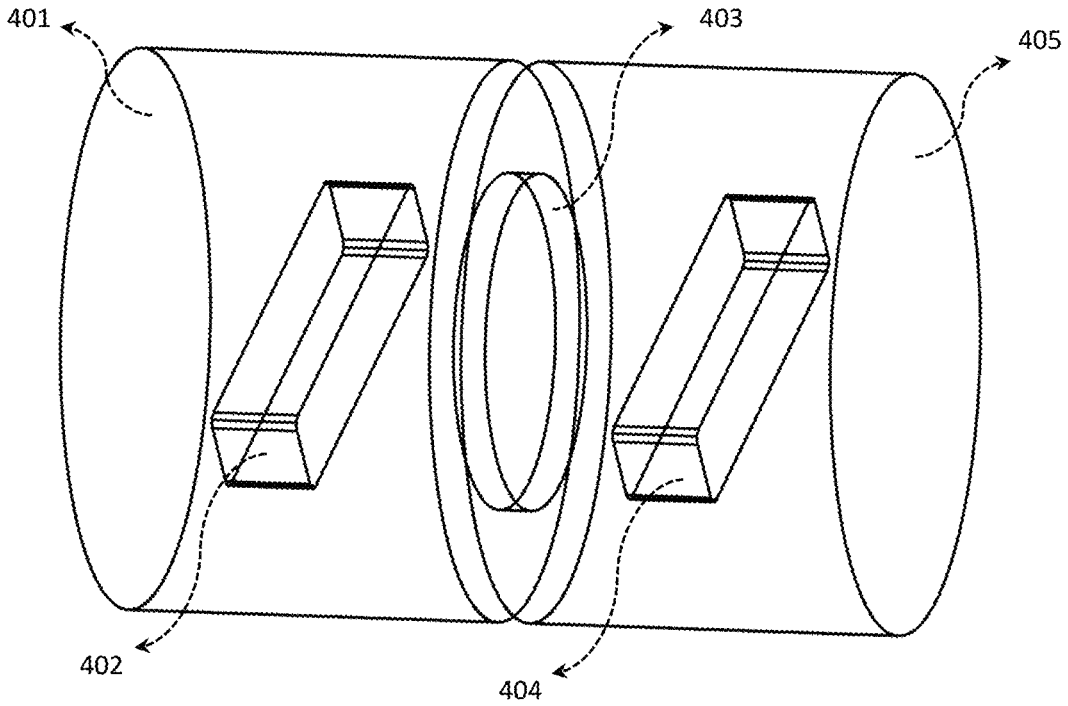
FIG. 4*a* shows the isometric view of the elliptic iris opening of the inter-resonator (IR) coupling.
Figure 4B:
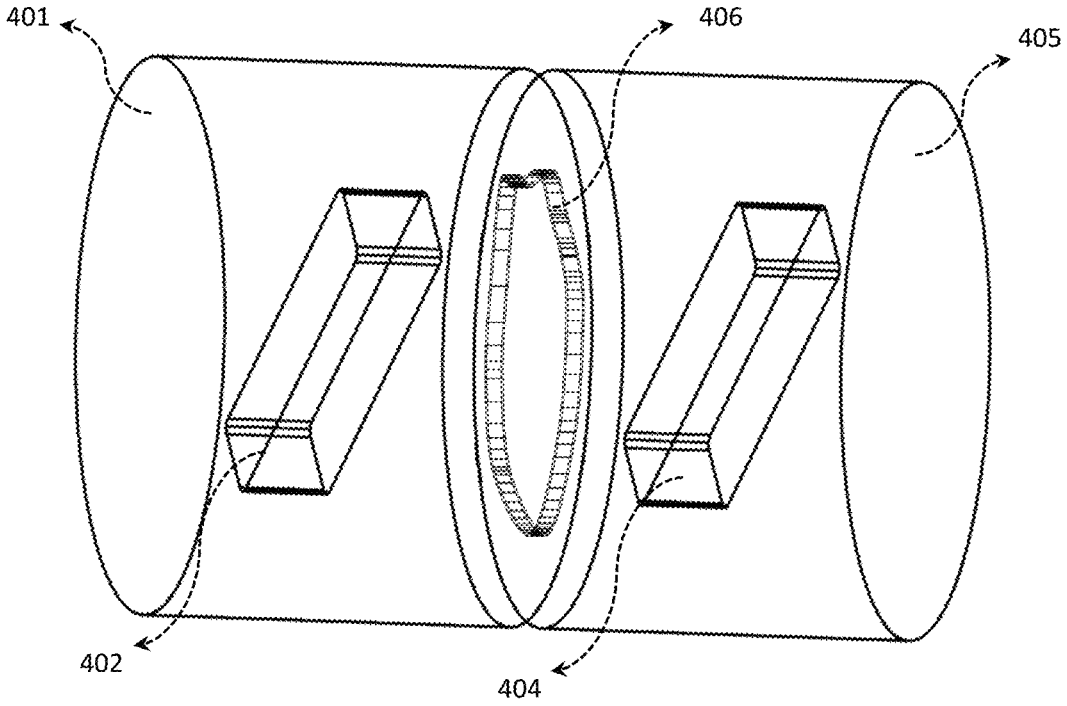
FIG. 4*b* shows the isometric view of an irregular iris opening of the inter-resonator (IR) coupling.
Figure 4C:
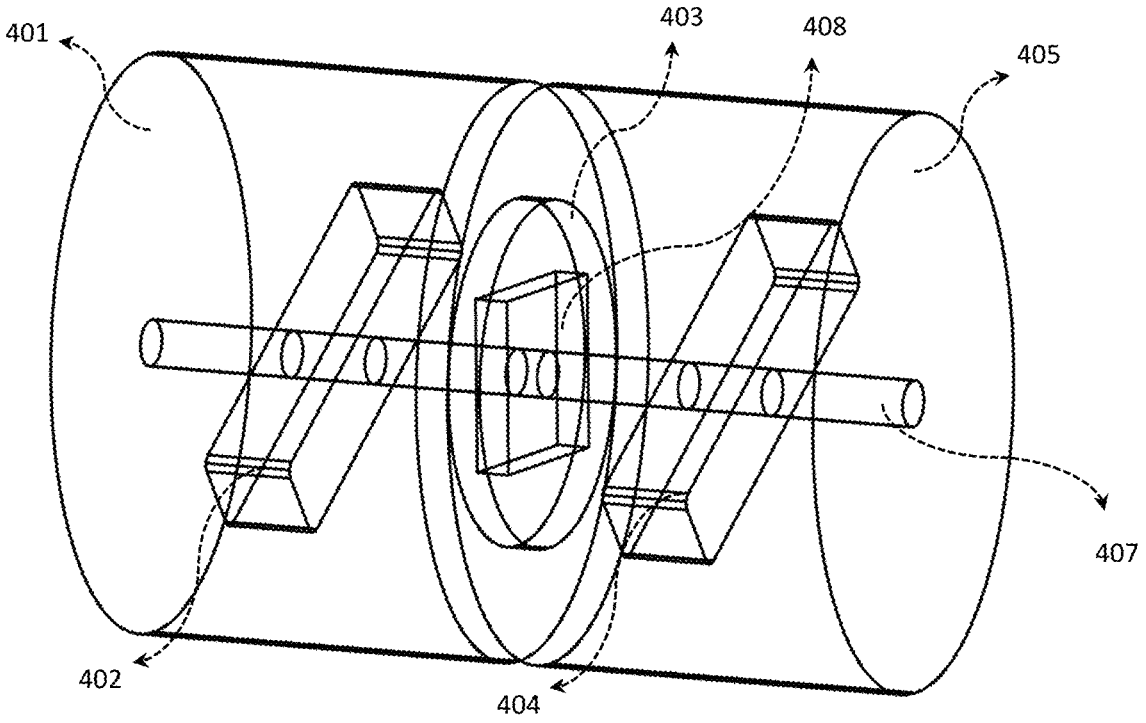
FIG. 4*c* shows an iris attached to the tuning rod that also rotates inside the enclosure along with the resonator posts.
Figure 5A:
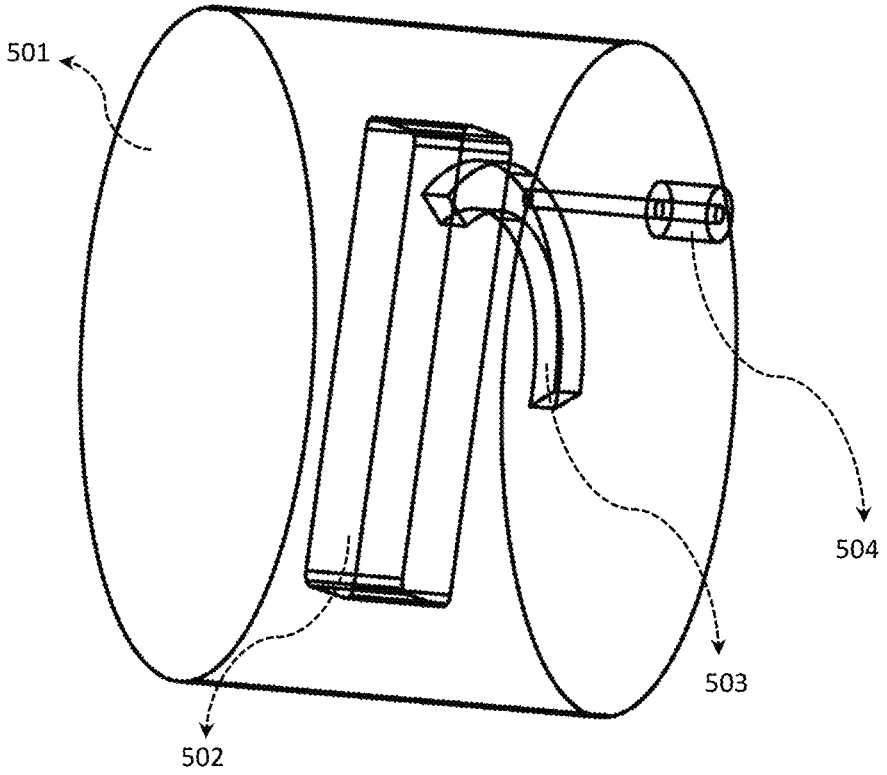
FIG. 5*a* shows the isometric view of input-output (IO) coupling of the shaped probe IO coupling.
Figure 5B:
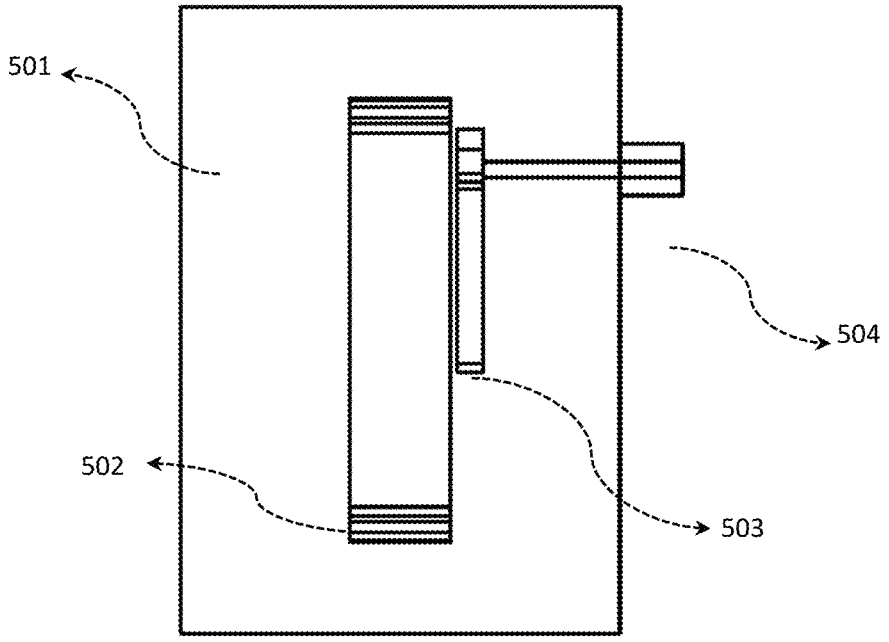
FIG. 5*b* shows the side view of input-output (IO) coupling of the shaped probe IO coupling.
Figure 5C:
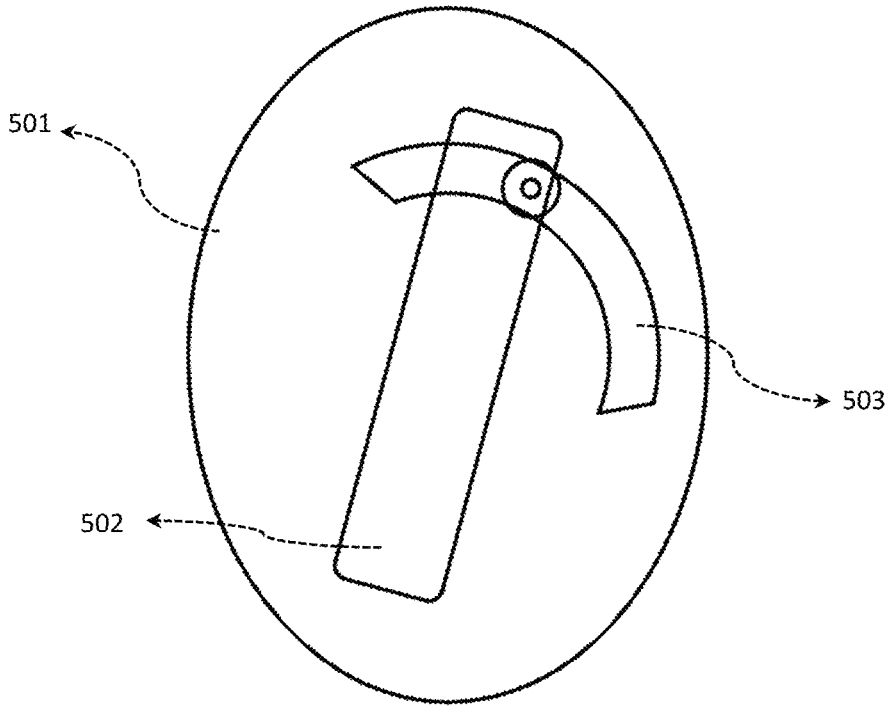
FIG. 5*c* shows the front view of input-output (IO) coupling of the irregular shaped probe IO coupling.
Figure 5D:
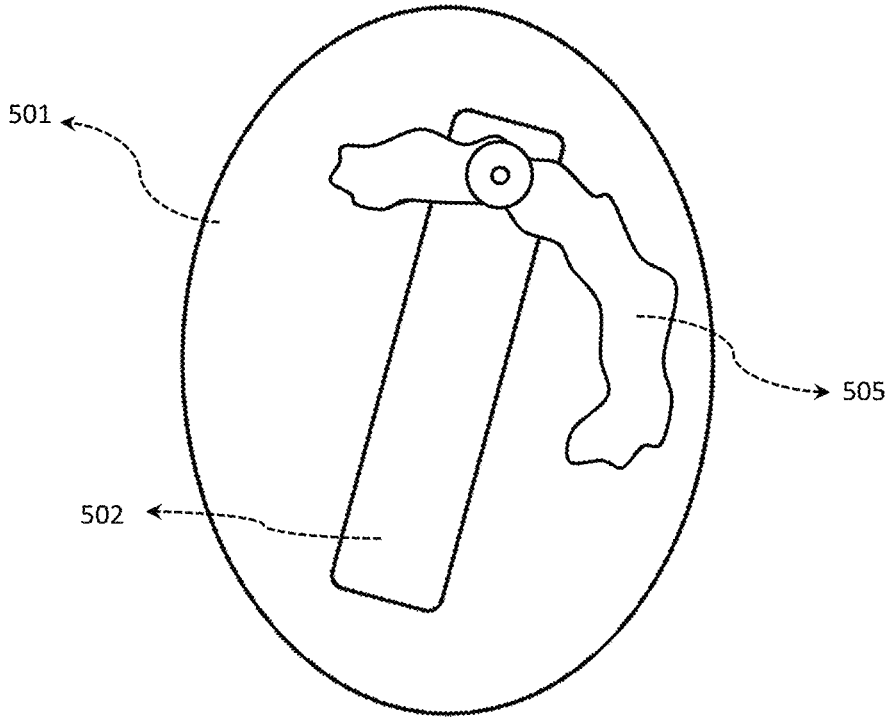
FIG. 5*d* shows the front view of input-output (IO) coupling of the irregular shaped probe IO coupling.
Figure 6A:
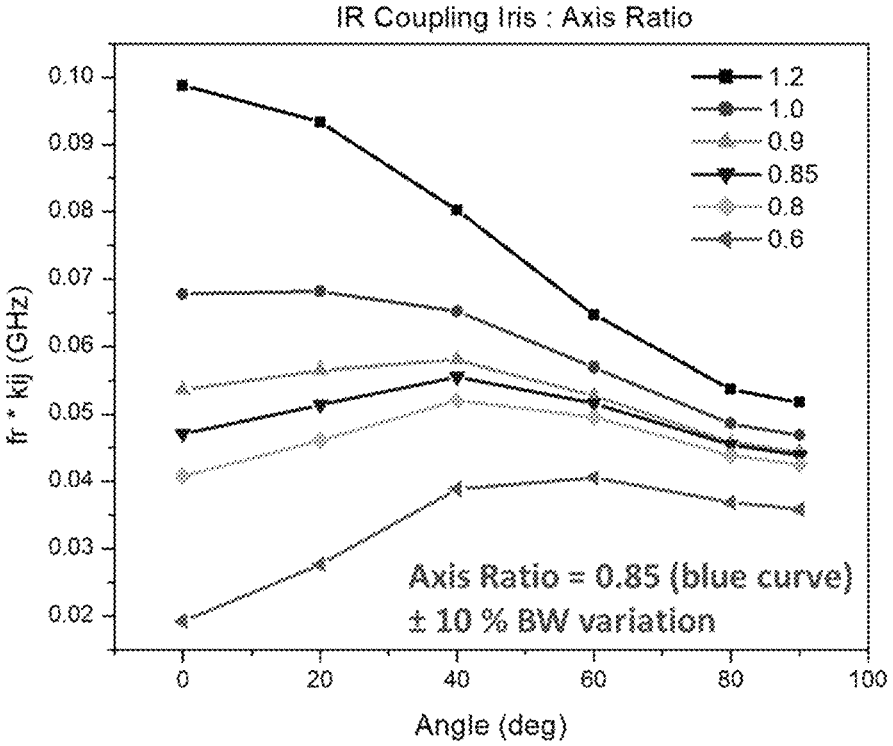
FIG. 6*a* is the plot of IR coupling by varying the axis ratio(=minor axis/major axis) for a fixed major axis.
Figure 6B:
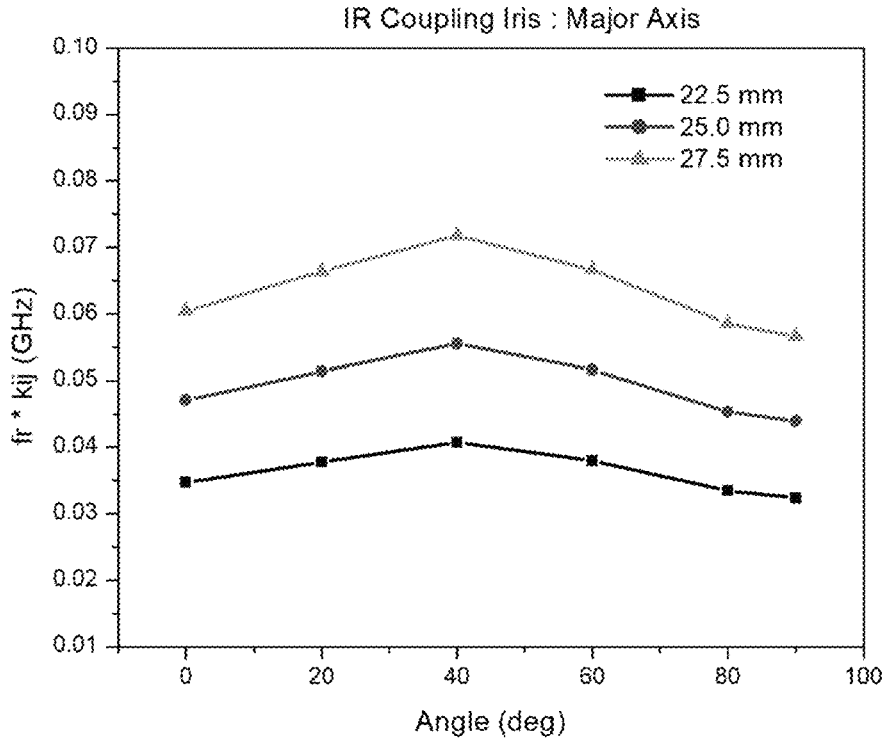
FIG. 6*b* shows the plot of IR coupling by varying the major axis for a fixed ratio.
Figure 6C:
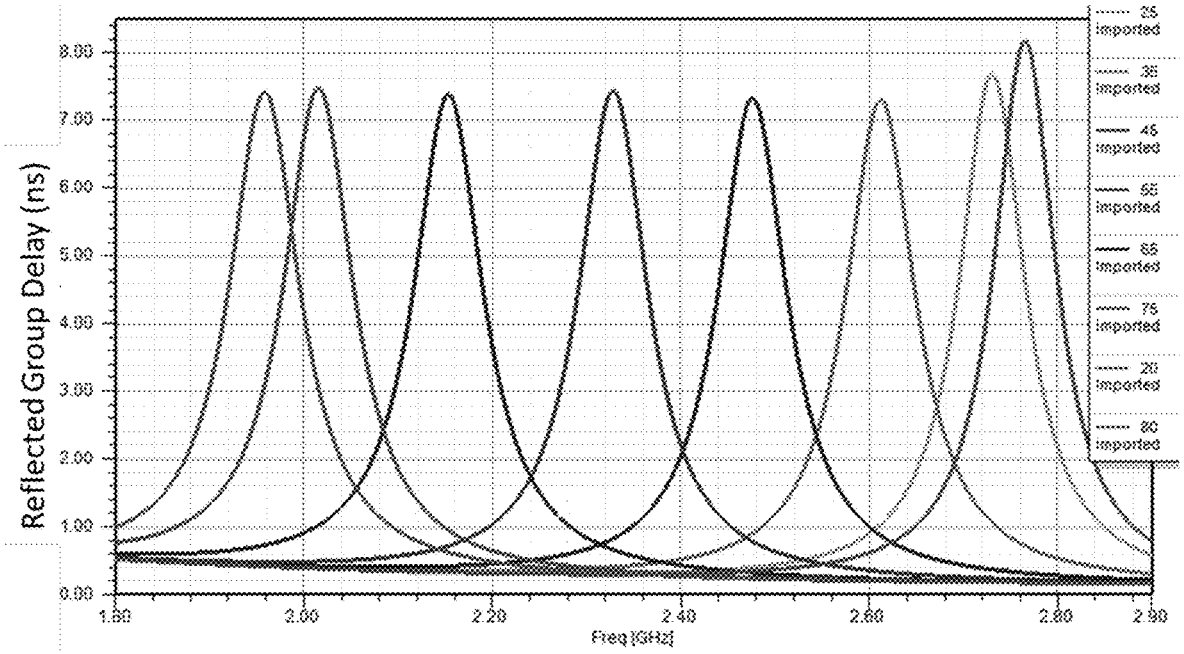
FIG. 6*c* is the plot of IO coupling.
Figure 6D:
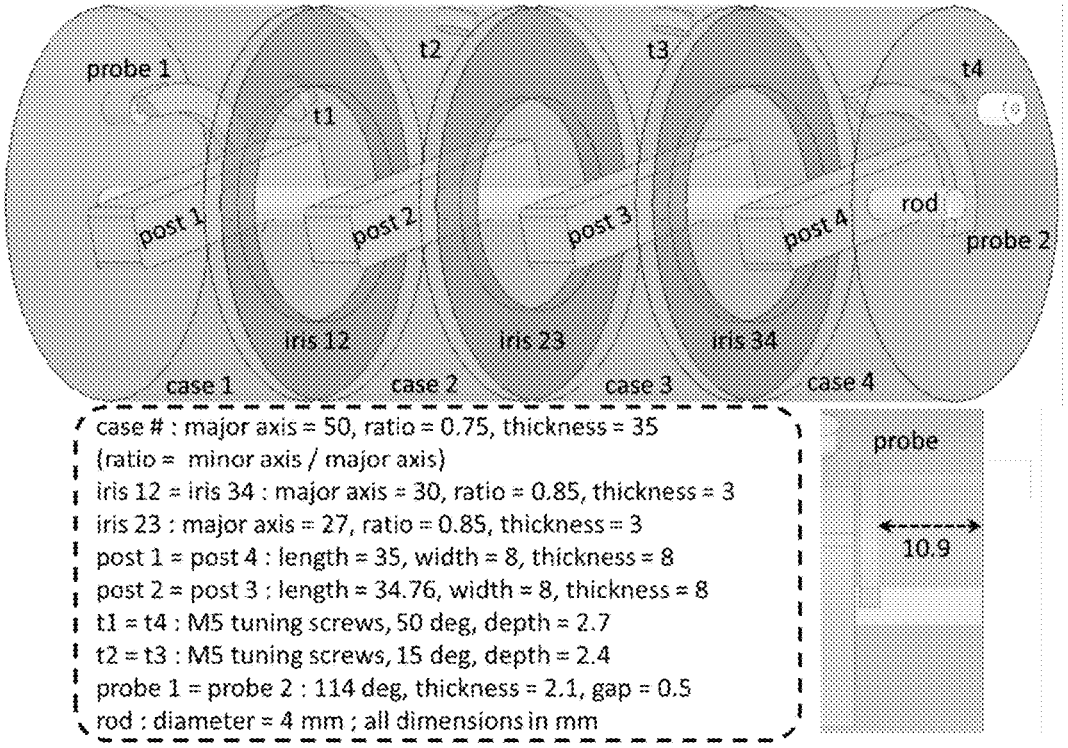
FIG. 6*d* shows the detailed internal dimensions of one embodiment of the present filter.

FIG. 4 depicts the drawings of inter-resonator (IR) coupling. Isometric view of the elliptic iris opening is shown in FIG. 4*a*. The iris opening 403 is elliptical and provides the required IR coupling as per the design criteria for achieving constant absolute BW over the tuning range. It is placed between two resonators (401&402 and 404&405). In general, the iris opening 406 can be shaped other than elliptic as shown in FIG. 4*b*. In-addition, a metal iris 408 can be attached to the tuning rod 407 such that the iris also rotates inside the enclosure along with the resonator posts as shown in FIG. 4*c*.

FIG. 5 depicts the drawings of input-output (IO) coupling. Isometric view of the shaped probe IO coupling is shown in FIG. 5*a*. The circular-shaped probe 503 is mounted on the SMA connector 504 within the resonator (501&502). As the resonator post is rotated the suitably shaped probe provides the required IO coupling as per the design criteria for achieving constant absolute BW over the tuning range. The side view is shown in FIG. 5*b*. It also depicts the gap between the shaped probe 503 and the resonator post 502. The front view is shown in FIG. 5*c*. In general, the probe 505 can be shaped other than elliptic as shown in FIG. 5*d*.

FIG. 6 shows the design plots and schematic of the prototype filter developed for the proof of concept. FIG. 6*a* is the plot of IR coupling by varying the axis ratio(=minor axis/major axis) for a fixed major axis. As can be seen from this plot, a specific value of axis ratio (around 0.85) provides the required IR coupling such that the absolute BW variation over the tuning range is minimum. FIG. 6*b* shows the plot of IR coupling by varying the major axis for a fixed ratio. This plot indicates that there is sufficient degree of freedom (i.e. major axis and axis ratio) to suitably design the iris opening for different values of inter resonator couplings. FIG. 6*c* is the plot of IO coupling. As can be seen from the plot, a suitably shaped and positioned probe provides the required IO coupling such that the absolute BW variation over the tuning range is minimum. The schematic of the filter with detailed internal dimensions is shown in FIG. 6*d*.

Figure 7A:
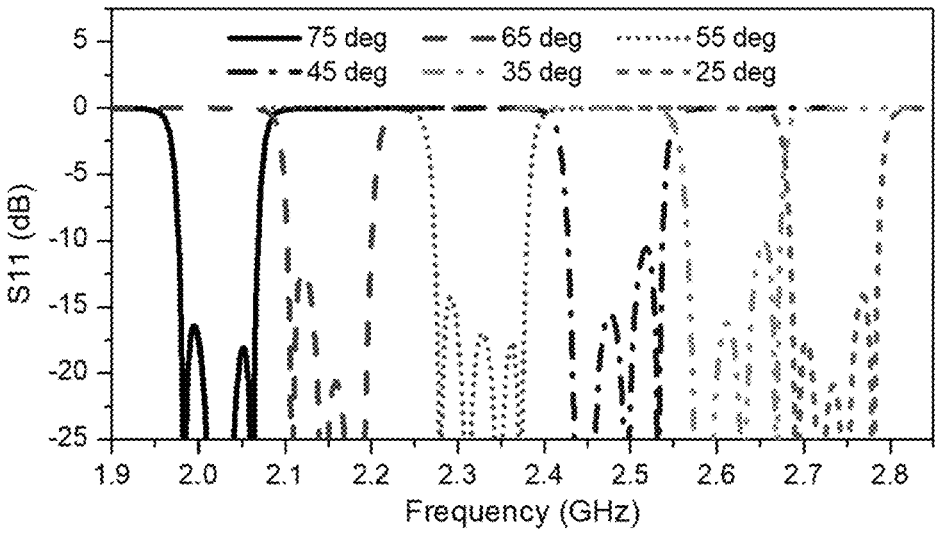
FIG. 7*a* is a plot of the filter response showing the transmission co-efficient ($S_{21}$)
Figure 7B:
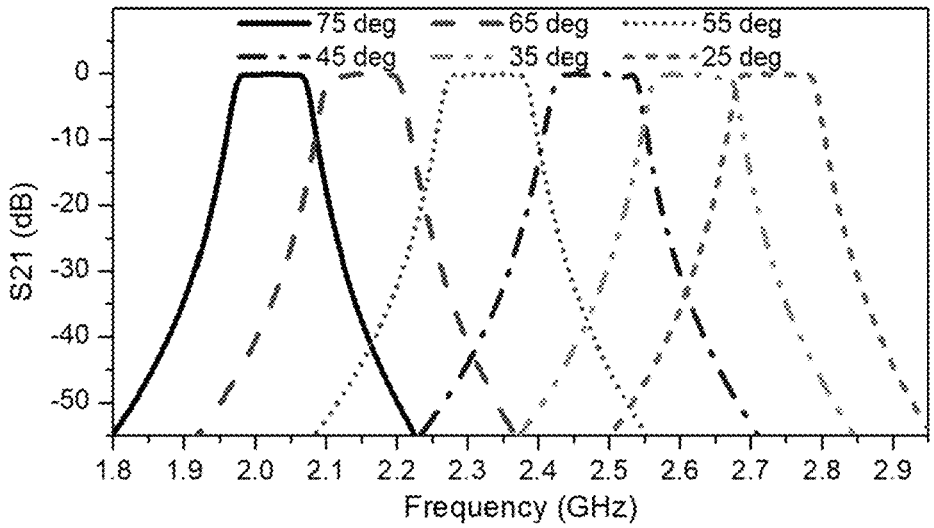
FIG. 7*b* is a plot of the filter response showing the reflection co-efficient ($S_{11}$) of the invention.
Figure 7C:
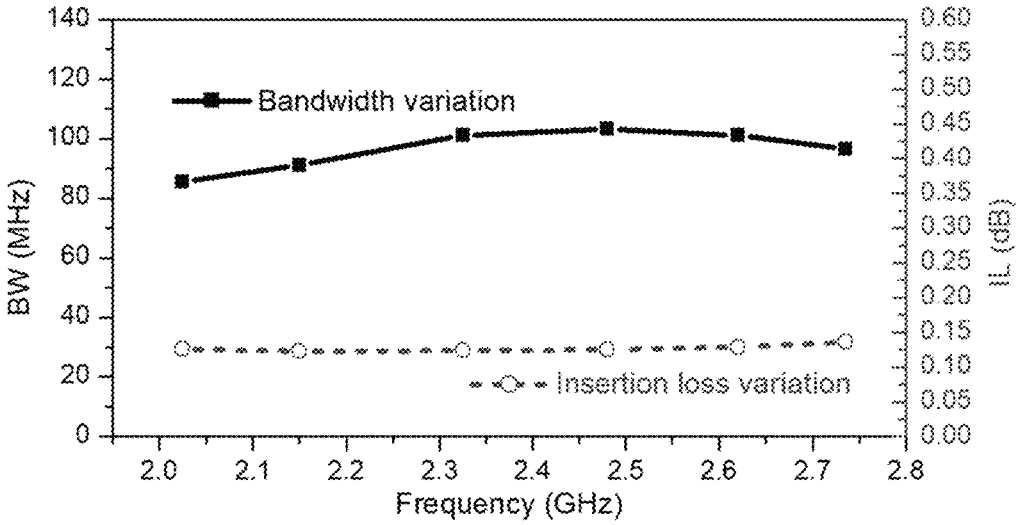
FIG. 7*c* shows the bandwidth variation and insertion loss variation over the tuning range.

FIG. 7 plots the filter response. The transmission co-efficient ($S_{21}$) and reflection co-efficient ($S_{11}$) of the invention i.e. tunable co-axial filter is shown FIG. 7*a* and FIG. 7*b*, respectively. The bandwidth variation and insertion loss variation over the tuning range is depicted in FIG. 7*c*.

Figure 8:
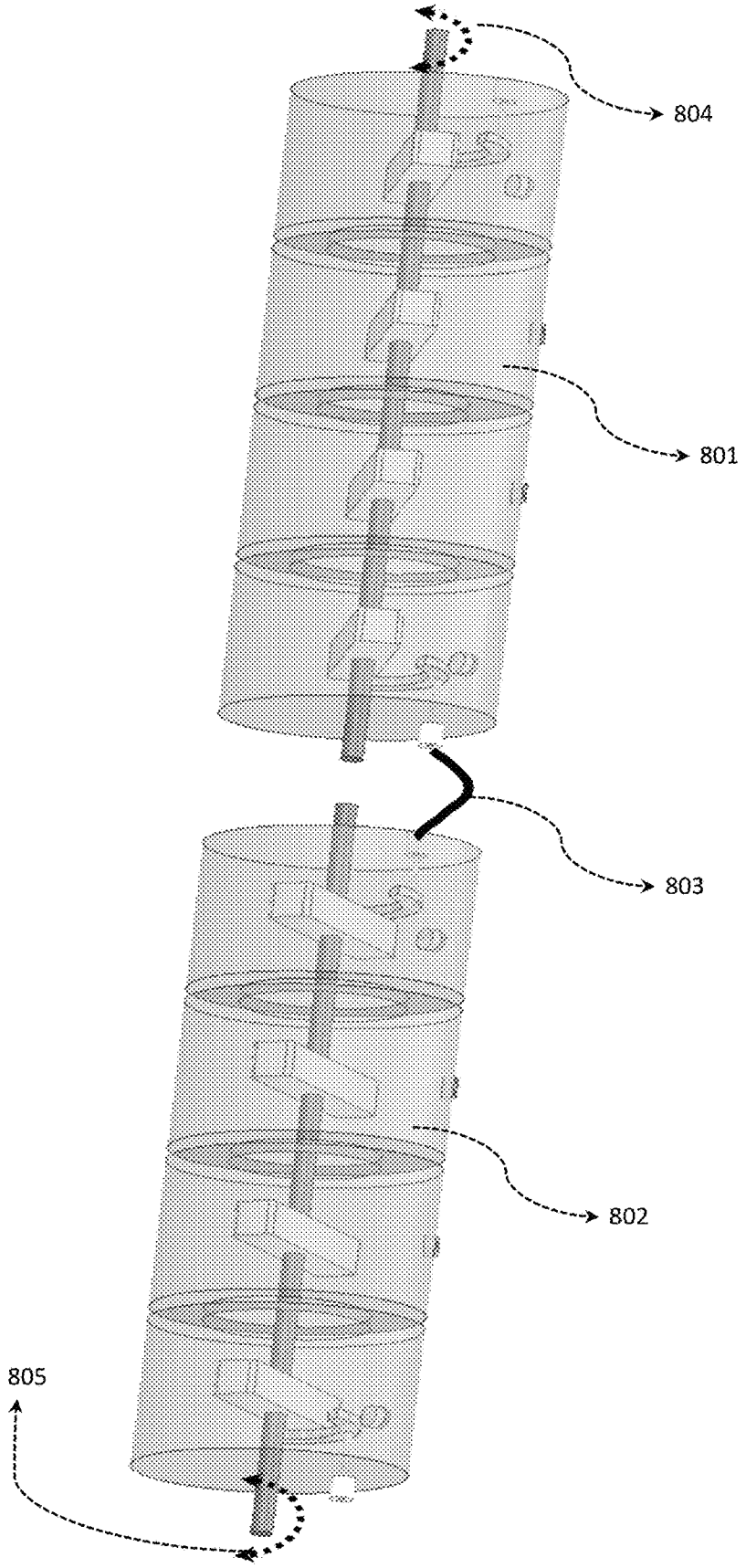
FIG. 8 shows a second embodiment of the invention, where both center frequency and bandwidth of the filter can be tuned by rotating the tuning rods.

FIG. 8 depicts the schematic of the second embodiment of the invention, where both center frequency and bandwidth of the filter can be tuned by rotating the tuning rods. Two filters 801 and 802 are cascaded. The output of one filter is connected to the input of the other filter using a cable 803. An isolator can also be used in-between the filters to improve the return loss performance. The tuning rods 804 and 805 can be rotated to tune the center frequency and bandwidth of the overall filter response.

Figure 9:
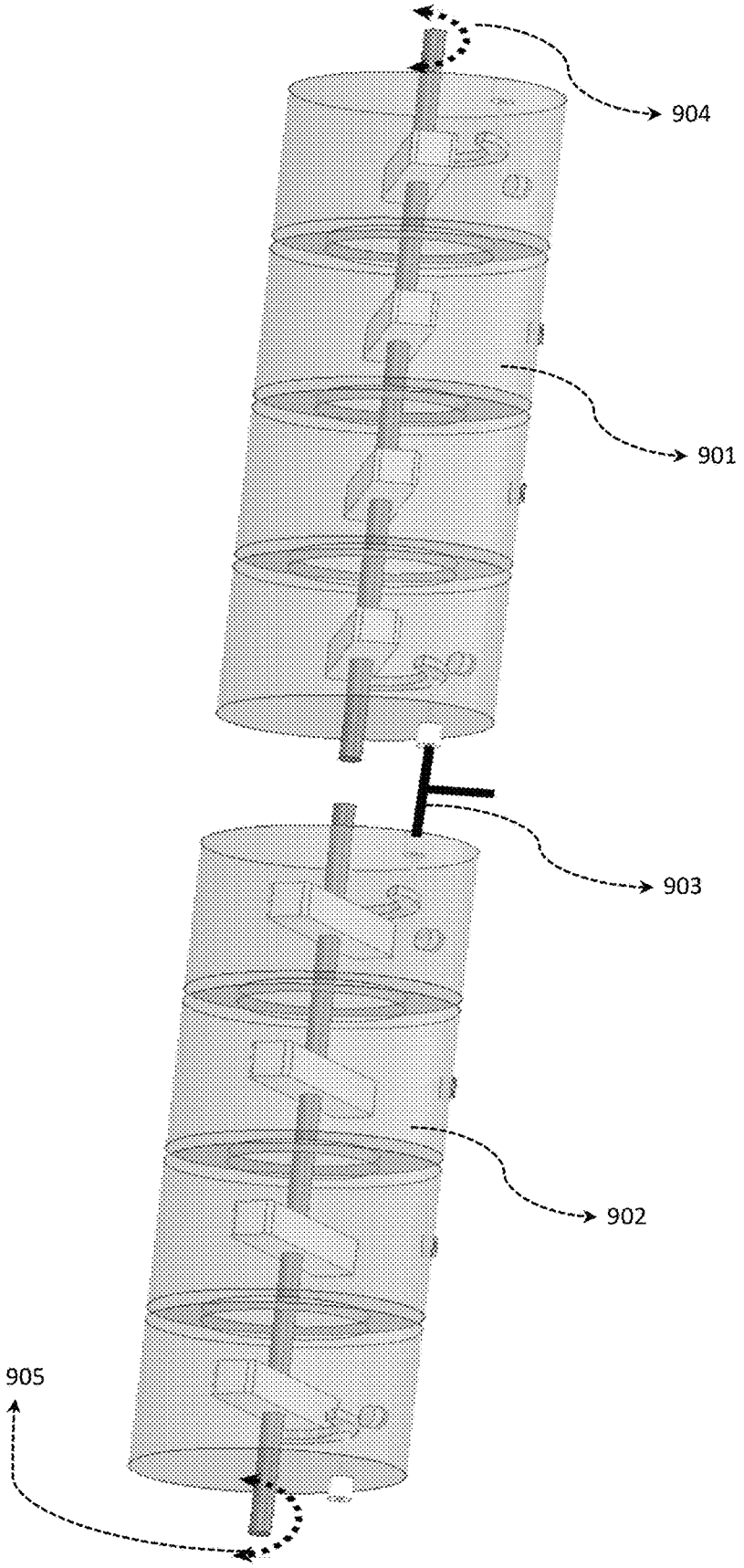
FIG. 9 shows a third embodiment of the invention, which is a diplexer using two filters.

FIG. 9 depicts the schematic of the third embodiment of the invention, which is a diplexer using two filters. Two filters 901 and 902 are connected using a junction diplexing 903. The two filters are tuned either by one tuning rod or two separate tuning rods (904 and 905).

Although the present invention has been fully described by way of example in connection with a preferred embodiment thereof, it should be noted that various changes and modifications will be apparent to those skilled in the art. By way of example, the techniques described above are not restricted to the shapes of the metallic or non-metallic elements illustrated in this application, other shapes of the metal (or di-electric i.e. ceramic) parts can be utilized to enhance the tuning range performance. Therefore, unless otherwise such changes and modifications depart from the scope of the present invention, they should be construed as being included therein.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description, it is to be realized that the optimum relationships for the parts of the invention regarding size, shape, form, materials, function and manner of operation, assembly and use are deemed readily apparent and obvious to those skilled in the art, and all equivalent relationships to those illustrated in the drawings and described in the specification are intended to be encompassed by the present invention.

What is claimed is:

1. A tunable filter comprising:

a) a plurality of tunable resonators aligned on a common filter axis, each comprising of a casing having an inner wall and a cavity;

b) a plurality of inter-resonator (IR) coupling structure to operably couple said plurality of tunable resonators to provide a balanced electromagnetic coupling;

c) a pair of end plates each having a SMA connector;

d) a rotating tuning rod inserted along the common filter axis into the pair of end plates and held by a bearing for easy rotation;

e) a plurality of posts having a post shape and placed on the rotating rod, each post is located in the cavity of a respective tunable resonator, wherein the shape of each post is selected to improve the spurious performance of the tunable filter, and whereby a gap between each post and the inner wall of each tunable resonator changes as the post rotates and hence the frequency of the resonator changes, and thereby rotating the post tunes the frequency of the resonator and hence the filter;

f) a plurality of probes mounted on to the SMA connector on each end plate;

g) a plurality of input/output ports to connect said tunable filter to an external device, each said port having one of said probe, wherein said probes have a plurality of coupling parameters to provide constant input/output coupling values while said filter center frequency is tuned;

h) a set of tuning screws mounted in the casing of each tunable resonator for fine tuning;

whereby the tunable filter is tuned by a single rotational mechanism irrespective of the filter order, and by rotating the rotating rod the filter center frequency is tuned while maintaining a constant absolute bandwidth and insertion loss over the tuning range, and a suitably shaped probe provides the required IO coupling as per the design criteria for achieving constant absolute BW over the tuning range.

2. The tunable filter of claim 1, wherein each inter-resonator (IR) coupling is an iris opening having an iris shape.

3. The tunable filter of claim 2, wherein the iris shape is elliptical having a minor axis and a major axis, wherein the IR coupling is changed by varying the ratio of minor axis/major axis for a fixed major axis.

4. The tunable filter of claim 2, wherein the iris shape is an irregular shape.

5. The tunable filter of claim 1, wherein the plurality of input/output ports have a plurality of circular-shaped probes mounted on to plurality of SMA connectors.

6. The tunable filter of claim 1, wherein each tunable resonator is elliptical having an elliptical cavity cross section.

7. The tunable filter of claim 1, wherein each tunable resonator has an irregular cavity cross section.

8. The tunable filter of claim 1, wherein the plurality of tunable resonators and the plurality of posts are metallic or dielectric.

9. The tunable filter of claim 1, wherein the rotating tuning rod is made of an insulating material or a combination of metal and an insulating material.

10. The tunable filter of claim 1, wherein the rotating tuning rod is made of PTFE or plastic.

11. The tunable filter of claim 1, wherein the post shape is rectangular or cuboidal or an irregular shape, to provide a predefined gap between the post and the cavity wall and obtain a predefined resonator center frequency.

12. The tunable filter of claim 1, wherein the post shape comprises of an elongated post having two ends and a hat on each end, thereby pushing the spurious frequencies further away, and whereby the resonator dimensions reduces due to extra capacitive loading.

13. The tunable filter of claim 1, wherein each inter-resonator (IR) coupling is attached to the rotating tuning rod, thereby the IR rotates inside the cavity together with the resonator posts, whereby the rotation of the resonator post and the IR inside the cavity yields a substantially constant absolute bandwidth and a constant insertion loss.

14. The tunable filter of claim 1, wherein the coupling between cavities is with fixed irises or with metal irises attached to the tuning rod that also rotate inside the enclosure along with the resonator posts.

15. The tunable filter of claim 1, wherein the probes are circular-shaped or an irregular shaped.

16. A cascade of tunable filters, each tunable filter comprising:

a) a plurality of tunable resonators aligned on a common filter axis, each comprising of a casing having an inner wall and a cavity;

b) a plurality of inter-resonator (IR) coupling structure to operably couple said plurality of tunable resonators to provide a balanced electromagnetic coupling;

c) a pair of end plates each having a SMA connector;

d) a rotating tuning rod inserted along the common filter axis into the pair of end plates and held by a bearing for easy rotation;

e) a plurality of posts having a post shape and placed on the rotating rod, each post is located in the cavity of a respective tunable resonator, wherein the shape of each post is selected to improve the spurious performance of the tunable filter, and whereby a gap between each post and the inner wall of each tunable resonator changes as the post rotates and hence the frequency of the resonator changes, and thereby rotating the post tunes the frequency of the resonator and hence the filter;

f) a plurality of probes mounted on to the SMA connector on each end plate;

g) a plurality of input/output ports to connect said tunable filter to an external device, each said port having one of said probe, wherein said probes have a plurality of coupling parameters to provide constant input/output coupling values while said filter center frequency is tuned;

h) a set of tuning screws mounted in the casing of each tunable resonator for fine tuning;

i) a plurality of cables, each cable connecting the output of one filter to the input of the other filter, whereby rotating the rotating rod tunes the filter center frequency and bandwidth of the cascade of filter.

17. The cascade of tunable filters of claim 16, wherein the cascade comprising of two tunable filters, and wherein the two tunable filters are tuned either by one rotating tuning rod or two separate rotating tuning rods.

18. The tunable filter of claim 16, further having an isolator in-between the tunable filters to improve the return loss performance, and wherein the two tunable filters are tuned either by one rotating tuning rod or two separate rotating tuning rods.

* * * * *